US006109311A

United States Patent [19]

Fournier et al.

[11] Patent Number: 6,109,311

[45] Date of Patent: Aug. 29, 2000

[54] METHOD OF RECOVERING VAPORS EMITTED WHEN A LIQUID IS DISPENSED

[75] Inventors: Jacques Fournier, Bretigny sur Orge; Claude Redon, Taverny, both of France

[73] Assignee: Solutions Services Systemes France, Le Plessis Robinson, France

[21] Appl. No.: 09/298,973

[22] Filed: Apr. 25, 1999

[30] Foreign Application Priority Data

Apr. 24, 1998 [FR] France ..... 98 05196

[51] Int. Cl.[7] ..... B65B 1/04

[52] U.S. Cl. ..... 141/59; 141/83; 73/40.5 R

[58] Field of Search ..... 141/59, 83; 73/40.5 R, 73/40.7, 49.1

[56] References Cited

U.S. PATENT DOCUMENTS

| | | | |
|---|---|---|---|
| 5,038,838 | 8/1991 | Bergamini et al. | 141/59 |
| 5,316,057 | 5/1994 | Hasselmann | 141/94 |
| 5,450,883 | 9/1995 | Payne et al. | 151/59 |

FOREIGN PATENT DOCUMENTS

| | | |
|---|---|---|
| 0 559 925 | 9/1993 | European Pat. Off. . |
| 2641267 | 7/1990 | France . |
| 2 9521 160 | 11/1996 | Germany . |
| WO 96/06038 | 2/1996 | WIPO . |
| WO 97/06095 | 2/1997 | WIPO . |

*Primary Examiner*—Steven O. Douglas
*Attorney, Agent, or Firm*—Seidel, Coonda, Lavorgna & Monaco, PC

[57] ABSTRACT

A method of recovering vapors emitted while dispensing liquids into an installation. A characteristic value descriptive of the recovery operation is taken from a calibration table set up during the previous dispensing operation. During the dispensing operation, the liquid flow rate and the vapor flow rate are measured at a predetermined time interval. A new characteristic value is determined on the basis of the calibration table from the previous dispensing operation. The liquid flow rate and new characteristic value are applied to the recovery operation. A coefficient is calculated based on the differences between the measured values of the liquid flow rate and the vapor flow rate. A new calibration table is set up with values calculated using the new characteristic value, the measured flow rates, and the coefficient, in readiness for the next dispensing operation.

7 Claims, 2 Drawing Sheets

METHOD OF RECOVERING VAPORS EMITTED WHEN A LIQUID IS DISPENSED

FIELD OF THE INVENTION

The present invention relates to a method of recovering vapor emitted when a liquid is dispensed into the interior of a tank.

The invention is of particular advantage when applied in the field of fuel distribution for motor vehicles. The invention may be used as a means of recovering the hydrocarbon vapor which escape from the tank of such vehicles when being filled with liquid fuel.

BACKGROUND OF THE INVENTION

A dispensing system for a liquid such as motor vehicle fuel generally consists of means for dispensing said liquid, essentially comprising distributors fitted with pumps designed to deliver the fuel from a storage tank to the tank of the vehicles at a liquid flow rate $Q_L$. The distributors also have a system for measuring the liquid, connected to a pulse generator enabling a computer to establish the volume and price of the fuel delivered, which are shown in text on a display with which the distributors are fitted.

When provided with a means for recovering the emitted hydrocarbon vapors, said system has recovery means designed to deliver said vapor at a vapour flow rate $Q_v$ through a passage from the tank of the vehicles to a collection tank, for example, the storage tank, the vapor flow rate $Q_v$ is controlled by a value g characteristic of said recovery means in order to maintain a ratio of proportionality $Q_v=k\,Q_L$ between the vapor flow rate $Q_v$ and the liquid flow rate $Q_L$ where k equals or is close to 1. Finally, a measuring means will enable the vapor flow rate $Q_v$ to be determined.

More often than not, said recovery means consists of a pump which sucks the vapor from the tank in order to deliver them to the hydrocarbon storage tank. This being the case, the characteristic value g will be the rotation speed of said pump, which is controlled by the pulse generator of the distribution means.

However, in the majority of cases, it is not possible to impose on the pump in a simple manner a speed which is proportional to the liquid flow rate $Q_L$.

In practice, the operating conditions can vary considerably from one system to another due to losses in pressure on the recovery passage, upstream and downstream of the pump.

There may be calibrated valves on a level with the collection tank which can cause a pressure therein that is different from atmospheric pressure, corresponding to an additional loss of pressure which is imposed on the pump in the recovery passage.

There may be an internal leakage in the recovery pump, dependent upon the upstream-downstream pressure differential which affects its efficiency.

In order to obtain a given vapor flow rate $Q_v$, a rotation speed must be imposed on the recovery pump and this rotation speed depends on the system.

In order to take account of the parameters mentioned above, it is common practice to calibrate the entire system when it is installed on the site. During this calibration procedure, a speed is set for the recovery pump and the corresponding vapor flow rate $Q_v$ is measured using a flow meter or gas counter. Accordingly, a ratio is established between the speed and the vapor flow rate $Q_v$ by taking a sufficient number of measurements to define the characteristic of the pump under these operating conditions. This ratio is stored in memory in a micro-processor.

During normal operation, the flow meter is shut off and when hydrocarbons are being dispensed at a liquid flow rate $Q_L$, the micro-processor searches the memory for the speed to be imposed on the recovery pump so that $Q_v=Q_L$.

However, this known recovery method has the following disadvantages.

Pressure losses may occur on the recycling passage over time as a result of gradual partial blocking due to dust, and the change in the section of elastomer pipes due to the prolonged presence of hydrocarbons. This is particularly prevalent in the part of the passage located upstream of the pump, which is generally provided in the form of an elastomer tube surrounded by pressurised liquid, this part representing the core of a coaxial flex pipe.

Internal leakage which might develop in the pump due to wear. As is the case with vane pumps, the density of the vapor which will vary depending on the hydrocarbons and the temperature of the vehicle tanks as the ambient temperature changes, thereby altering the effect upstream and downstream pressure losses will have.

The vapor pressure in the collection tank may also vary depending on the hydrocarbons and the temperature.

Consequently, the technical problem to be resolved by the invention is that of proposing a method of recovering vapor emitted when liquid is being dispensed to a tank with the aid of a system comprising:

- means for dispensing the liquid, designed to deliver said liquid at a liquid flow rate $Q_L$ from a storage tank to said tank,
- means for measuring said liquid flow rate $Q_L$,
- means for recovering vapor, designed to deliver said vapor at a vapour flow rate $Q_v$ from the tank to a collection tank, said vapor flow rate $Q_v$ being controlled by a value g characteristic of said recovery means, and
- means for measuring said vapor flow rate $Q_v$.

This method takes account of the gradual change in characteristic parameters of the vapor as it is fed along the recovery passage, enabling a time-delayed recalibration of the characteristic value g to be performed as a function of the measured vapour flow rate $Q_v$.

BRIEF SUMMARY OF THE INVENTION

The present invention is directed to a method of recovering vapors emitted when a liquid is dispensed. The method comprises the steps of:

- the recovery means are initially calibrated by air suction by varying said value g and by measuring, for each value $g^0$, of g, the corresponding vapor flow rate $Q_{vi}$ of air in order to build an initial calibration table $T_0$:

$$T_0=[g^0_i,Q_{vi}]$$

with each dispensing of liquid n:

- the liquid flow rate $Q_L$ is measured at a regular time interval and a value $g^{n-1}_j$ of the value g is determined and is applied to the recovery means on the basis of the calibration table $T_{n-1}=[g^{n-1}_i,Q_{vi}]$ $$T_{n-1}=[g^{n-1}_j,Q_L] \text{ where } Q_{vi}=Q_L,$$

the vapor flow rate $Q_v$ is measured at each time interval, a coefficient $K_n$ of similarity is calculated on the basis of the differences between the measured values of $Q_L$ and $Q_v$, and a new calibration table $T_n$ is set up in readiness for the next dispensing operation n+1 by means of:

$$T_n=[g^n{}_i,Q_{vi}]=K_n\cdot T_g.$$

The value used by the method of the invention for the characteristic value g when liquid is being dispensed is a value determined from the calibration table set up during the preceding dispensing operation while an updated calibration table is set up in readiness for the next dispensing operation.

In order to take account of any pressure drops in the passages, the vapor flow rate $Q_v$ is measured by a vapor flow rate value Q supplied by a flow meter connected in series with the recovery means. The flow rate is corrected by a pressure factor P/Pa where P is the pressure measured on a level with said flow meter and Pa is atmospheric pressure.

The improved method comprises:

during said initial calibration step, an initial correlation table Ho is set up linking the vapor flow rate $Q_v$ to the flow rate Q of vapor indicated by the flow meter (123):

$$[H_0=[Q^0{}_i,Q_{vi}]$$

during the liquid dispensing operation n:

the flow rate $Q^n$ of vapor indicated by the flow meter is compared at each time interval with the flow rate $Q^{n-1}{}_j$ defined by the correlation table $H_{n-1}$, $$H_{n-1}=[Q^{n-1}{}_j,Q_L] \text{ where } Q_{vi}=Q_L,$$

the value $g^{n-1}{}_j$ is adjusted during the dispensing operation so that the value of $Q^n$ moves closer to that of $Q^{n-1}{}_j$, at the end of the dispensing operation, a second coefficient $k_n$ of similarity is calculated on the basis of the differences between the measured values of $Q^n$ and $Q_v$, a new correlation table $H_n$ is established in readiness for the next dispensing operation n+1 by means of:

$$H_n=[Q^n{}_1,Q_{vi}]=k_n\cdot H_0.$$

During the dispensing operation, this improvement enables the value $g^{n-1}{}_j$ to be adjusted by the value g supplied by the calibration table so that the vapor flow rate $Q_v$ is as close as possible to the flow rate $Q_{vi}$ defined by the table $H_{n-1}$ and therefore to the liquid flow rate $Q_L$ without, however, actually reaching this latter.

Two specific but not exclusive approaches to implementing the method of the invention are proposed.

In a first approach, said recovery means consist of a recycling pump with a fixed speed and a valve with a variable opening, the characteristic value g being the effective passage section of said valve.

In a second approach, said recovery means consist of a recovery pump with a variable speed, said characteristic value g being the speed of said recovery pump.

BRIEF DESCRIPTION OF THE DRAWINGS

The description given below with reference to the appended drawings, provided by way of example and not restrictive in any respect, will provide an understanding of what the invention involves and how it can be implemented.

DETAILED DESCRIPTION OF THE INVENTION

Figure 1:
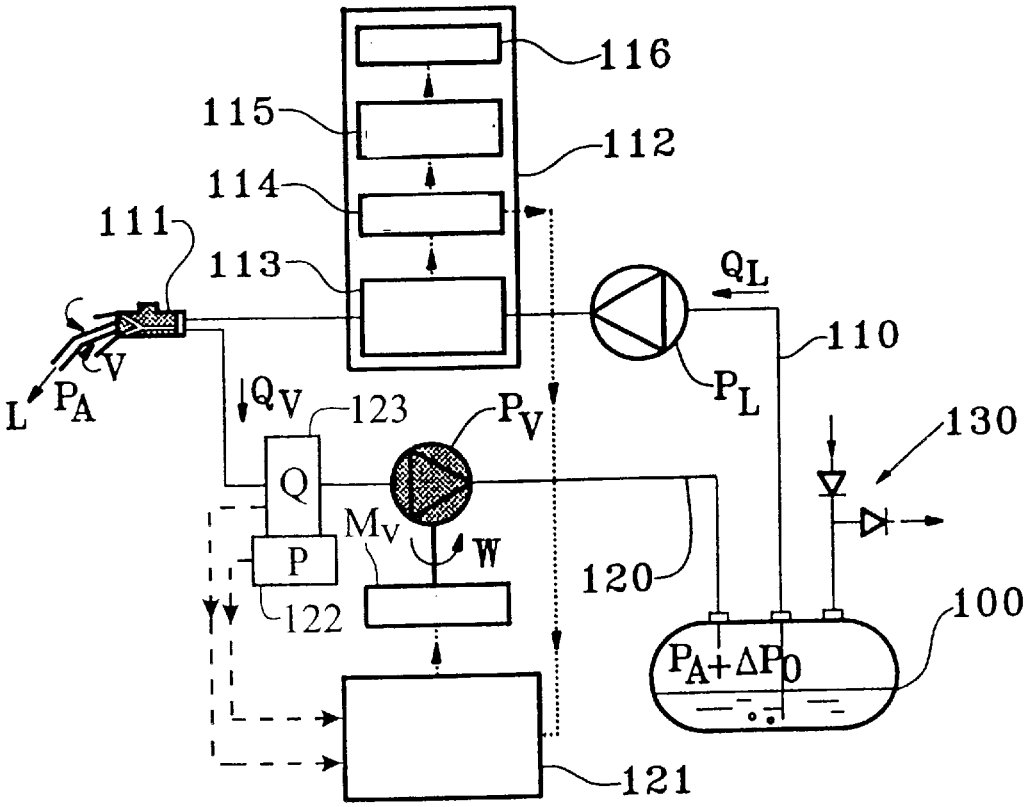
FIG. 1 is a diagram of a first approach to implementing the method proposed by the invention.

The diagram of FIG. 1 illustrates an installation for dispensing liquid, for example fuel, to the interior of a tank of a motor vehicle, not illustrated.

This installation has fuel dispensing means, essentially consisting of a pump $P_L$ designed to deliver said fuel L at a liquid flow rate $Q_L$ from a storage tank 100 to said tank along a passage 110 to a dispenser gun 111.

As already mentioned above, a distributor 112, possibly incorporating the liquid pump $P_L$, has a measuring means 113 disposed on the passage 110 in series with the pump $P_L$ so that a pulse generator 114, coupled with said measuring means 113, will supply a pulse signal representative of the liquid flow rate $Q_L$ which a computer 115 then translates into volume and price for a display 116.

The installation illustrated in FIG. 1 also has means for recovering vapor V emitted as the liquid is dispensed to the vehicle tank. In the example of FIG. 1, said recovery means mainly consists of a recovery pump $P_v$ having a variable speed w, designed to deliver said vapor at a vapour flow rate $Q_v$ along a passage 120, from the tank, passing via the dispenser gun 111, to a collection tank 100 which, in the case of FIG. 1, is also the storage tank for the liquid fuel.

In a practical manner, the vapor flow rate $Q_v$ is measured by a vapor flow rate value Q supplied by a flow meter 123 disposed in series with the pump $P_v$, Q being corrected by a pressure factor P/Pa where P is the pressure measured by a sensor 122 on a level with the flow meter 123 and Pa is atmospheric pressure:

$$Q_v=Q\times P/Pa.$$

As an example, the flow meter 123 may advantageously be a fluid oscillator.

Figure 2:
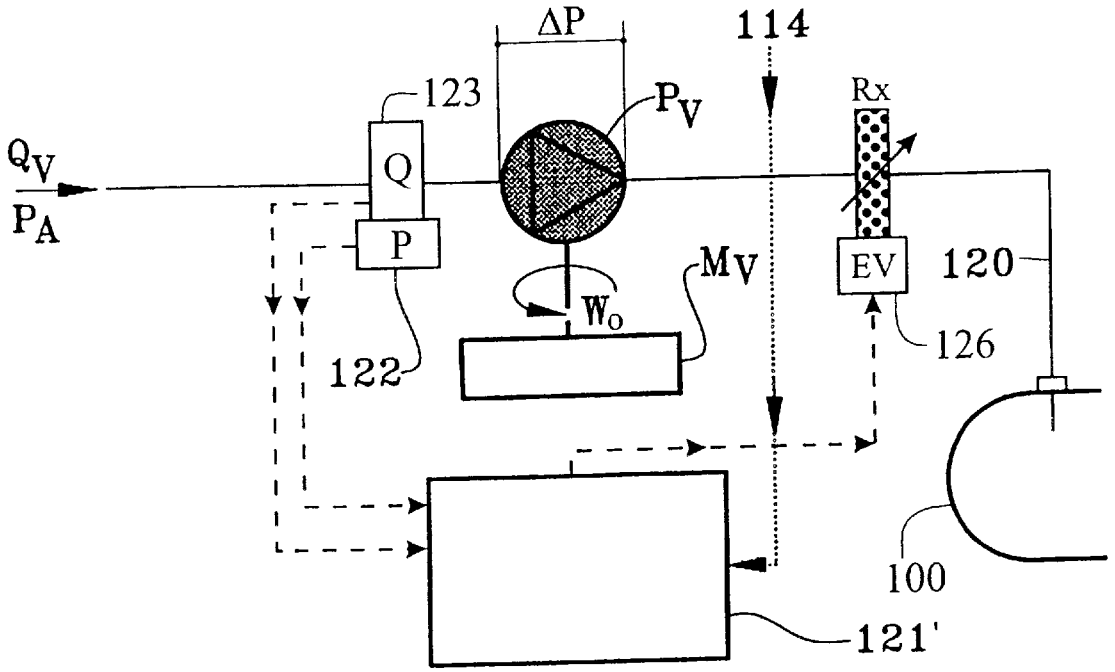
FIG. 2 is a diagram of a second approach to implementing the method proposed by the invention.

In the case of FIG. 2, the recovery means consist of a pump $P_v$ having a fixed speed wo and a valve 126 with a variable opening.

Regardless of the embodiment selected, the method proposed by the invention generally consists in imposing a value g characteristic of the recovery means for a value such as the vapor flow rate $Q_v$ which, as a result, is as close as possible to the liquid flow rate $Q_L$. In the examples of FIGS. 1 and 2, the value g is the variable speed w of the recovery pump $P_v$ and the effective passage section Rx of the valve 126 respectively.

To this end, an electronic control system 121, 121' receives on the one hand information pertaining to the liquid flow rate $Q_L$ from the pulse generator 114 and, on the other, information pertaining to the vapor flow rate $Q_v$ from measuring means 123, 122. This information is then processed by the electronic control system so that a control signal can be applied to the motor $M_v$ of the recovery pump $P_v$ or the solenoid valve 126, for the purposes of bringing the characteristic value g, speed w of the pump $P_v$ or effective section Rx of the solenoid valve 126, to a value determined by the electronic control system which will make the best match between the flow rates $Q_v$ and $Q_L$.

The method of the invention includes a first initial phase of calibrating the recovery means by air suction.

During this first phase, the flow of liquid is not activated. The pump $P_v$ for recovering the vapor, on the other hand, is started, enabling air to be sucked in via the orifice of the gun 111. The control electronics 121 or 121' apply to the motor $M_v$ of the pump $P_v$ or the solenoid valve 126 an excitation signal which is set for a period Δt, corresponding to a value $g^0$ of the relevant characteristic value g, the index 0 indicating that this is the initial calibration phase. The excitation signal is then incremented step by step, which produces an increase step by step in the value $g^0$. Consequently, a known value $g^0_i$ and a value $Q_{vi}$ for the vapor flow rate resulting from the flow rate $Q_i$ reading taken from the flow meter 123 and corrected by the pressure factor Pi/Pa corresponds to each step i.

The set of pairs $g^0_i$ and $Q_{vi}$ constitutes an initial calibration table $T_0$:

$$T_0=[g^0_i,Q_{vi}].$$

This table $T_0$, illustrated by the curve of FIG. 2, is stored in memory in the electronic control system.

After the initial calibration, the recovery device is ready to dispense liquid for the first time. The user unhooks the gun 111 and fills the tank of his vehicle at a liquid flow rate $Q_L$, the value of which is transmitted from the measuring means 113 to the electronic control system which will then search the table $T_0$ for the value $g^0_j$ to be imposed on the corresponding value g at $Q_{vj}=Q_L$.

$$T_0=[g^0_j,Q_L]$$

At this stage, the vapour flow rate corresponding to $g^0_j$ cannot reach $Q_L$ because the device has been calibrated with air. Since, in the case of a fuel, the density of vapor from the liquid is higher than that of air, the fall in pressure increases, which tends to decrease the absolute pressure P on the suction side of the pump $P_v$ and as a result reduces the vapor flow rate $Q_v$. If $Q_L$ is actually to be reached, g would have to be increased to a value $g_j$ indicated in FIG. 3, in order to compensate for the drop in efficiency of the recovery pump $P_v$. This is precisely the objective of the method proposed by the invention. In effect, during the dispensing operation, the liquid flow rate $Q_L$ is measured at regular intervals, for example every 500 ms, and stored in memory in the electronic control system. For each value of $Q_L$ measured in this way, the value $g^0_j$ to be applied to the value g is derived from the table $T_0$. Measurements and readings for the values Q are taken from the flow meter 123 and P from the pressure sensor 122 and are also stored in memory every 500 ms.

At the end of the first dispensing operation, the value $Q_v$ of the vapor flow rate is derived from each pair of stored values of Q and P by the equation:

$$Q_v=Q\times P/Pa.$$

Finally, a coefficient $K_1$ of similarity is calculated on the basis of the differences observed between the different values of $Q_L$ and $Q_v$, in order to establish a new calibration table $T_1$ to be used for the next dispensing operation:

$$T_1=[g^1_i,Q_{vi}]=K_1\cdot T_0$$

The coefficient $K_1$ of similarity may be calculated in the following manner, for example. For each measurement 1 taken every 500 ms, a ratio $K^1_1$ defined by:

$$K^1_1=Q_{L1}/Q_{v1}.$$

is calculated, the coefficient $K_1$ being obtained as the average of all the ratios $K^1_1$.

Then:

$$T_1=[K_1,g^0_i,Q_{vi}].$$

With the second dispensing operation, the measurement of the liquid flow rate $Q_L$ will enable a corresponding value $g^1_j$, which is to be applied to the value g, to be determined by means of:

$$T_1=[g^1_j,Q_L].$$

This time, if no significant change is produced in terms of pressure losses in the passage 120 and the density of the vapor, the vapour flow rate $Q_v$ imposed by $g^1_j$ will be substantially equal to the liquid flow rate $Q_L$. In general, there will be variations if the temperature of the recovery pump $P_v$ varies, particularly if there is a rapid succession of customers at the service station during peak times. Similarly, throughout the day, vehicles become hotter as does the fuel in their tanks and the density of the vapor increases.

In the same way as with the first dispensing operation, the values of Q and P are stored at regular intervals so that, when the dispensing operation is finished, it will be possible to calculate a series of values for $Q_v$ which will be compared with the corresponding values of $Q_L$ and can then be used to derive a new coefficient $K_2$ of similarity and determine a new calibration table $T_2$:

$$T_2=[g^2_j,Q_{vi}]=K_2\cdot T_0$$

which will be used for the third dispensing operation, the same process being repeated from one dispensing operation to the next.

The use of a flow meter 123 and a pressure sensor 122 will enable any anomalies to be detected in the operation of the vapor recovery device, such as:

- an abnormal change in the pressure loss. If the pressure loss is too great, there may be a blockage in the passage, or a leak if it is too low.
- an inability to reach the desired vapor flow rate even when the speed w of the pump $P_v$ or the effective section Rx of the valve 126 is at its maximum value. This will indicate either that the pump $P_v$ is worn or that the drop in pressure in the recovery passage is too high,
- the vapor flow rate $Q_v$ is zero when the liquid flow rate $Q_L$ is not zero. From this it can be concluded that the pump $P_v$ is out of use.

In all instances, it will be possible to trigger an alarm.

The method of recovering vapor described above can be improved in the following way.

During the initial calibration phase using air suction, in addition to the calibration table $T_0$, another table $H_0$ is set up, referred to as the initial correlation table, which links the vapor flow rate $Q_v$ to the flow rate of vapor Q indicated by the flow meter 122 for each step i:

$$H_0=[Q^0_i,Q_{vi}].$$

Figure 3:
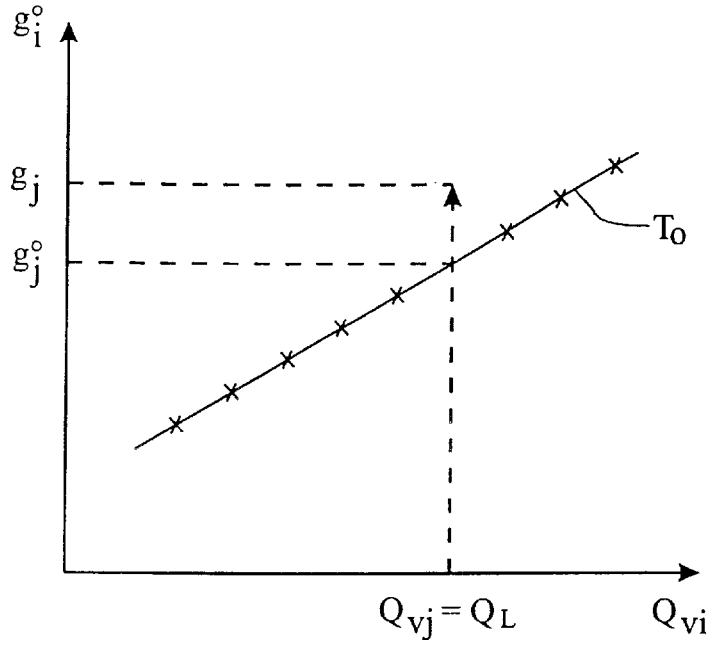
FIG. 3 is a graph illustrating an initial calibration table as proposed by the method of the invention.

This table $H_0$, illustrated on the curve of FIG. 3, represents the ratio between the flow rate of vapor read from the flow meter and the real vapor flow rate. This curve changes depending on the density of the vapor and the fall in pressure in the passage.

When liquid such as fuel is dispensed for the first time, the electronic control system searches the initial calibration table $T_0$ for the value $g^0_j$ to be imposed on the value g for the period of 500 ms corresponding to $Q_{vj}$–$Q_L$, as explained above. During the same period, the values of $Q^1$, $P^1$ and $Q_L$ are placed in memory. Again, because operation is with fuel vapor whereas the table $T_0$ was produced with air, the real flow rate of vapor $Q_v$ will be too low ($Q_v<Q_L$).

The electronic control system will then compare the flow rate $Q^1$ indicated by the flow meter with the value $Q^0_j$ at each time interval:

$$H_0=[Q^0_j,Q_L].$$

Figure 4:
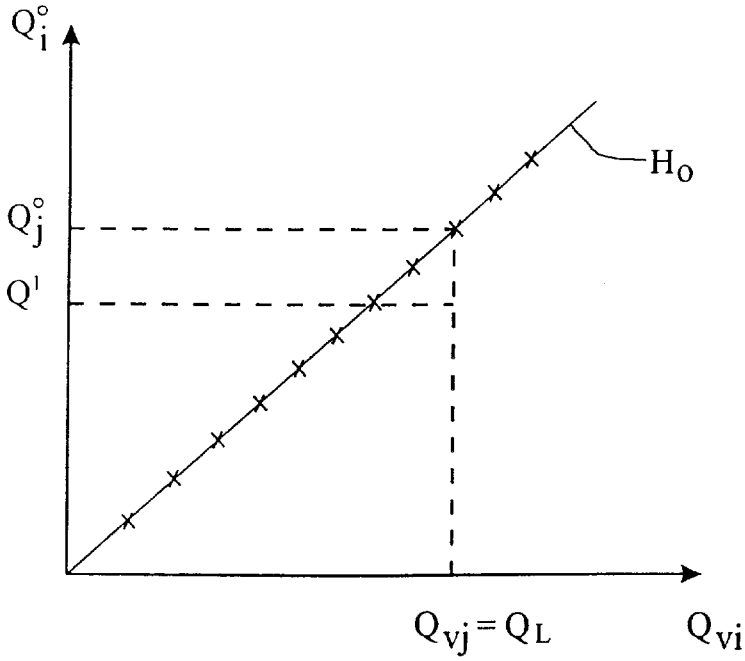
FIG. 4 is a graph illustrating a table of initial correlation as proposed by the method of the invention.

In general, $Q^1<Q^0_j$ (see FIG. 4). In order to compensate for this discrepancy, the value of g is adjusted during the dispensing process starting from $g^0_j$ so that the value of $Q^1$ will move closer to that of $Q^0_j$ until it is eventually the same as it.

At the end of the first dispensing operation, the electronic control system uses the values of $Q^1_1$ and $P^1_1$ stored in memory for each regular interval 1 of 500 ms to define a series of vapor flow rate values $Q_{vi}=Q^1_1\times P^1_1/Pa$, which will enable a second coefficient $k^1_1$ of similarity to be determined on the basis of the differences between $Q^1_1$ and $Q_{vi}$ and a coefficient $k_1$ of similarity obtained as the average of the coefficients $k^1_1$. This coefficient $k_1$ is used to update the correlation table $H_0$ in readiness for the next liquid dispensing operation:

$$H_1=k_1\cdot H_0=[Q^1_1,Q_{vi}].$$

For example, $k^1_1=Q^1_1/Q_{vi}$ and $$H_1=[k_1Q^0_i,Q_{vi}].$$

The method is repeated in an identical manner for the second and subsequent dispensing operations.

What is claimed is:

1. A method of recovering vapor emitted when liquid is being dispensed to a tank with the aid of an installation comprising:

means ($P_L$) for dispensing the liquid, designed to deliver said liquid at a liquid flow rate $Q_L$ from a storage tank (100) to said tank, means (113) for measuring said liquid flow rate $Q_L$, vapor recovery means ($P_v$; 126) capable of delivering said vapours at a vapor flow rate $Q_v$ from the tank to a collection tank (100), said vapor flow rate $Q_v$ being controlled by a value g (w; Rx) characteristic of said recovery means, means (123, 122) for measuring said vapor flow rate $Q_v$, characterised in that said method incorporates the following steps, consisting in:

performing an initial calibration of the recovery means (Pv; 126) by air suction by varying said value g, and measuring, for each value $g^0_1$ of g the corresponding vapor flow rate $Q_{vi}$ for air in order to build an initial calibration table $T_0$:

$$T_0=[g^0_i,Q_{vi}]$$

with each liquid dispensing operation n:

measuring the liquid flow rate $Q_L$ at a regular time interval and determining a value $g^{n-1}_1$ of the value g to be applied to the recovery means with the aid of the calibration table $T_{n-1}=[g^{n-1}_i, Q_{vi}]$ $$T_{n-1}=[g^{n-1}_j,Q_L] \text{ where } Q_{vi}=Q_L,$$

measuring the vapour flow rate $Q_v$ at each time interval, calculating a coefficient $K_n$ of similarity based on the differences between the measured values of $Q_L$ and $Q_v$, building a new calibration table $T_n$ to be used for the next dispensing operation n+1 by means of $$T_n=[g^n_i,Q_{vi}]=K_n\cdot T_0.$$

2. A method as claimed in claim 1, characterized in that the vapor flow rate $Q_v$ is measured by a vapor flow rate value Q supplied by a flow meter (123) arranged in series with the recovery means ($P_v$; 126), Q being corrected by a pressure factor P/Pa where P is the pressure measured by a pressure sensor (122) on a level with said flow meter and Pa is atmospheric pressure.

3. A method as claimed in claim 2, characterized in that:

during said initial calibration step, an initial correlation table $H_0$ is built linking said vapor flow rate $Q_v$ to the vapor flow rate Q indicated by the flow meter (123):

$$H_0=[Q^0_i,Q_{vi}]$$

during liquid dispensing operation n:

the flow rate $Q^n$ of vapor indicated by the flow meter (123) is compared at each time interval with the flow rate $Q^{n-1}_j$ defined by the correlation table $H_{n-1}$, $$H_{n-1}=[Q^{n-1}_j,Q_L] \text{ where } Q_{vi}=Q_L,$$

the value $g^{n-1}_j$ is adjusted during dispensing so that the value of $Q^n$ moves closer to that of $Q^{n-1}_j$, at the end of the dispensing operation, a second coefficient $k_n$ of similarity is calculated on the basis of the differences between the measured values $Q^n$ and $Q_v$, a new correlation table $H_n$ is built which will be used for the next dispensing operation n+1 by means of:

$$H_n=[Q^n_i,Q_{vi}]=k_n\cdot H_0.$$

4. A method as claimed in any one of claim 1 characterized in that said recovery means consist of a pump ($P_0$) having a fixed speed and a valve (126) with a variable opening, said characteristic value g being the effective passage section (Rx) of said valve (126).

5. A method as claimed in any one of claim 1, characterized in that said collection means consist of a recovery pump ($P_v$) having a variable speed w, said characteristic value g being the speed w of said recovery pump.

6. A method as claimed in claim 5, characterized in that said means for measuring the vapor flow rate $Q_v$ is a fluid oscillator.

7. A method as claimed in claim 8, characterized in that an alarm device is triggered in the event of any anomalies in values of the flow rate Q and pressure P.

* * * * *